US005154041A

United States Patent [19]

Schneider

[11] Patent Number: 5,154,041

[45] Date of Patent: Oct. 13, 1992

[54] WRAP-AROUND CARTON PACKING APPARATUS AND METHOD

[75] Inventor: Richard S. Schneider, Brewerton, N.Y.

[73] Assignee: Schneider Packaging Equipment Co., Inc., Brewerton, N.Y.

[21] Appl. No.: 725,311

[22] Filed: Jul. 8, 1991

[51] Int. Cl.[5] ..... B65B 43/10

[52] U.S. Cl. ..... 53/456; 53/491; 53/566; 53/376.5; 53/377.4; 493/125; 493/128

[58] Field of Search ..... 53/284.5, 376.5, 377.3, 53/377.4, 377.6, 382.2, 383.1, 456, 462, 484, 491, 566, 556; 493/122, 123, 124, 125, 126, 128, 130

[56] References Cited

U.S. PATENT DOCUMENTS

| | | | |
|---|---|---|---|
| 2,804,738 | 9/1957 | Shenigo | 53/376.5 |
| 3,302,367 | 2/1967 | Talarico | 53/491 |
| 3,332,207 | 12/1967 | Midnight | 53/207 |
| 3,543,469 | 12/1970 | Ullman | 53/456 |
| 3,981,122 | 9/1976 | Johnson | 53/374 |
| 3,986,319 | 10/1976 | Puskarz et al. | 53/26 |
| 4,010,597 | 3/1977 | Nelson | 53/376.5 |
| 4,026,090 | 5/1977 | Loveland | 53/377.3 |
| 4,079,573 | 3/1978 | Livingston et al. | 53/376.5 X |
| 4,249,978 | 2/1981 | Baker | 156/291 |
| 4,250,693 | 2/1981 | Andersson | 53/556 X |
| 4,480,421 | 11/1984 | Rece | 53/75 |
| 4,563,169 | 1/1986 | Virta et al. | 493/126 X |
| 4,569,182 | 2/1986 | Leuvering | 53/456 |
| 4,838,846 | 6/1989 | Focke et al. | 493/132 |
| 4,894,104 | 1/1990 | Hemus | 156/152 |

FOREIGN PATENT DOCUMENTS

| | | |
|---|---|---|
| 1-153402 | 6/1989 | Japan . |
| 1-153403 | 6/1989 | Japan . |

*Primary Examiner*—John Sipos
*Assistant Examiner*—Daniel B. Moon
*Attorney, Agent, or Firm*—Venable, Baetjer & Howard

[57] ABSTRACT

Method and apparatus are provided for effecting sealing of a carton panel such as the top panel to a manufacturer's joint in such a fashion that carton erection from a pre-formed carton blank can proceed in an in-line manner without any changes in the direction of carton transport as it is erected, filled and sealed. Panel sealing is accomplished by folding the manufacturer's joint over a free end of the panel, applying an adhesive to the manufacturer's joint while it is in overlying relation with the panel, lifting the panel over the manufacturer's joint, and urging the panel into engagement with the manufacturer's joint so as to become bonded thereto. Top panel sealing in the foregoing manner proceeds without the necessity of using the carton contents as a mandrel against which the manufacturer's joint is otherwise ordinarily folded, thereby permitting the carton to be erected and sealed along its manufacturer's joint in the absence of product received within the carton.

40 Claims, 10 Drawing Sheets

162
234
230
236
232
237
226
218b
42
31b
218
212
202
210
214
174
200
204
208
205
154
206
175
172
170
180
176
181
178
179
152
254
253
240
216
220
222
224
266
186
218a
228
230
242
238
26b
32
31a
187
188
189
194
192
190
184
182
177
156
158
18
160
164
150
168
166
39

154
200
152
177
156
182
237
202
212
224
228
188
238
26a
192
32
39
158

WRAP-AROUND CARTON PACKING APPARATUS AND METHOD

BACKGROUND OF THE INVENTION

1. Field of the Invention

The invention relates generally to apparatus and methods for packing articles in a carton, and more particularly to apparatus and methods for forming cartons from carton blanks and for filling such cartons, optimally during the course of carton formation.

2. Description of the Related Art

In many manufacturing and processing facilities, the goods or articles being produced are individually wrapped or otherwise packaged to preserve and maintain product integrity and quality until they are opened further down the product distribution chain by the end user. In such instances, it is desirable to package the goods in aggregate form within cartons prior to transport to the end user distribution site in order to facilitate handling of large quantities of product and to protect the product from damage during the course of handling and transport at the origination and destination sites. Goods to be packaged in this manner include many pre-packaged and loose consumer goods such as foodstuffs (e.g., cereals) and other boxed and canned goods, consumer electronics and supplies therefor, and the like. The cartons are typically formed from generally planar carton blanks which are optimally filled during the course of carton formation. The carton blanks are generally comprised of four panels which, when folded along score lines separating the panels, form the top, base and sidewalls of a rectangular carton. A pair of flaps extend from the sides of each panel to form the carton ends. A fifth panel or manufacturer's joint extends from an end of one of the panels to allow for carton sealing with an adhesive, tape, staples or other fastening means. In instances where it is desirable to form a sealed carton, the goods are used as a mandrel against which the carton blank manufacturer's joint is folded, applied with a sealant such as hot melt adhesive, and secured against the carton blank panel forming an exterior side of the carton. Illustrative of the foregoing type of wrap-around carton packing apparatus and methods is the Model 5WR carton packing system manufactured by Schneider Packaging Equipment Company, Inc. of Brewerton, N.Y., the assignee of the invention disclosed and claimed herein.

Carton packing equipment of the type described above is oftentimes operated at a high rate of carton blank folding and product throughput in order to maximize product packing and shipping efficiency. During the course of such high volume operation, as well as during even lower volume operating cycles, adhesive sprayed by the apparatus toward the manufacturer's joint incident to carton sealing can overshoot or run from the manufacturer's joint onto the underlying product package to be encased by the carton. Such adhesive spray overshoot or run-off is sometimes not visually detected by equipment operators present during the course of product packing and is therefore allowed to dry, resulting in an unsightly adhesive residue on the product package which can adversely impact upon the product's marketability once it reaches its destination and is unpacked from its packing carton. Furthermore, product damage can result in instances where the adhesive bonds together the product package and the surrounding carton. For all of the foregoing reasons, it is desirable to ensure proper application of the adhesive to the manufacturer's joint. At the present time, proper adhesive application can best be obtained by operating the pack apparatus at a less than optimal rate of throughput and by instituting more frequent (and therefore costly) inspections and servicing of the various apparatus components to ensure, among other things, that buildup at the adhesive applicator is minimized so as to lessen the occurrence of adhesive spray dispersion beyond the predetermined spray pattern. However, these measures have the unfortunate effect of reducing packing productivity and increasing operating expenses, which offsets the benefit of having automatic packing machinery in the first place.

SUMMARY OF THE INVENTION

In view of the foregoing limitations of the prior art, it is an object and advantage of the disclosed invention to provide wrap-around carton packing apparatus and methods which maximize packing efficiency as well as minimizing product damage and loss resulting from adhesive overspray during the course of carton sealing. These and other objects and advantages of the disclosed invention will become apparent from the following description when read in conjunction with the accompanying drawings.

In one aspect of the invention, a method is provided for packing one or more articles within a carton. In the disclosed method, at least one carton blank is provided having a plurality of panels and a manufacturer's joint extending from an end of one of the panels located at a first of two carton blank ends. The panels are folded to a generally J-shaped configuration, and one or more articles to be packaged within the folded carton blank is inserted therein. The panels are further folded around the article to substantially surround the article so as to position the panel at the carton blank second end adjacent to the manufacturer's joint. The manufacturer's joint is folded toward the carton blank second end panel so as to preferably overlie the second end panel, and means such as an adhesive for securing the carton to the manufacturer's joint is applied. The carton blank second end panel is folded over the manufacturer's joint to secure the second end panel to the manufacturer's joint, thereby enclosing the article within a sealed carton. Folding of the manufacturer's joint in this manner can proceed without use of the carton contents as a mandrel against which the second end panel is folded, thereby minimizing the application of compressive force against the contents of the carton. Further, the foregoing folding process positions the manufacturer's joint along the interior surface of the carton, rather than along its exterior surface, thereby enhancing stackability of the carton and minimizing the presence of discontinuous surfaces against which carton handling equipment and other neighboring cartons can become caught.

Preferably, side flaps extending from opposite sides of each panel are folded and secured during carton blank folding so as to produce a sealed carton having sealed ends. In instances where a generally rectangular-shaped carton is to be fabricated, the carton blank is comprised of two width and two length panels which are arranged in an alternating configuration. Preferably, the manufacturer's joint extends from a free end of one of the width panels in order that the spring bias arising from folding of the manufacturer's joint toward the second end (length) panel can be utilized to enhance adhesive engagement of the manufacturer's joint with the overlying panel.

In a second aspect of the invention, an apparatus is provided for folding and sealing the manufacturer's joint of a carton blank. The apparatus includes an assembly for pivotably displacing a free end of a carton blank top panel to a position adjacent to a lower end of the manufacturer's joint and for folding the manufacturer's joint rearwardly over the top panel free end so as to orient the manufacturer's joint rearwardly. A sealant applicator is operable to apply a suitable sealant such as hot melt adhesive to the manufacturer's joint, preferably while the manufacturer's joint is overlying the top panel free end. A lifting assembly pivotably displaces the top panel free end away from the manufacturer's joint to permit manufacturer's joint bending apparatus to displace or tuck the manufacturer's joint rearward so as to underlie the top panel, after which the top panel is urged downwardly by top panel sealing apparatus into superposed engagement with the manufacturer's joint so as to become bonded thereto.

In a preferred aspect of the manufacturer's joint folding aspect of the invention, the top panel displacement assembly is operatively coupled or slaved to operation of the manufacturer's joint folding assembly so that the respective assemblies can be controlled by a single actuation device such as a pressurized fluid (i.e., pneumatic) cylinder. Independently controllable pressurized fluid cylinders can be provided for controlling operation of the respective top panel lifting, manufacturer's joint bending, and top panel sealing apparatus, the latter two of which can be arranged so as to be operable along a common pivot axis. The top panel lifting apparatus can further include apparatus such as rollers for exerting a downward force against the top panel following top panel sealing as the carton is advanced to further carton forming stations. The rollers are preferably independently and resiliently mounted to accommodate reaction forces exerted by the carton alone or in combination with its contents, and can be adjustably tensioned to permit the equipment user to vary the force to be exerted against the sealed top panel as the carton is transported away from the top panel sealing assembly.

BRIEF DESCRIPTION OF THE DRAWINGS

Further objects and advantages of the disclosed invention will become apparent from a reading of the following description when read in conjunction with the accompanying drawings, in which.

DETAILED DESCRIPTION OF THE PREFERRED EMBODIMENTS

Figure 1:
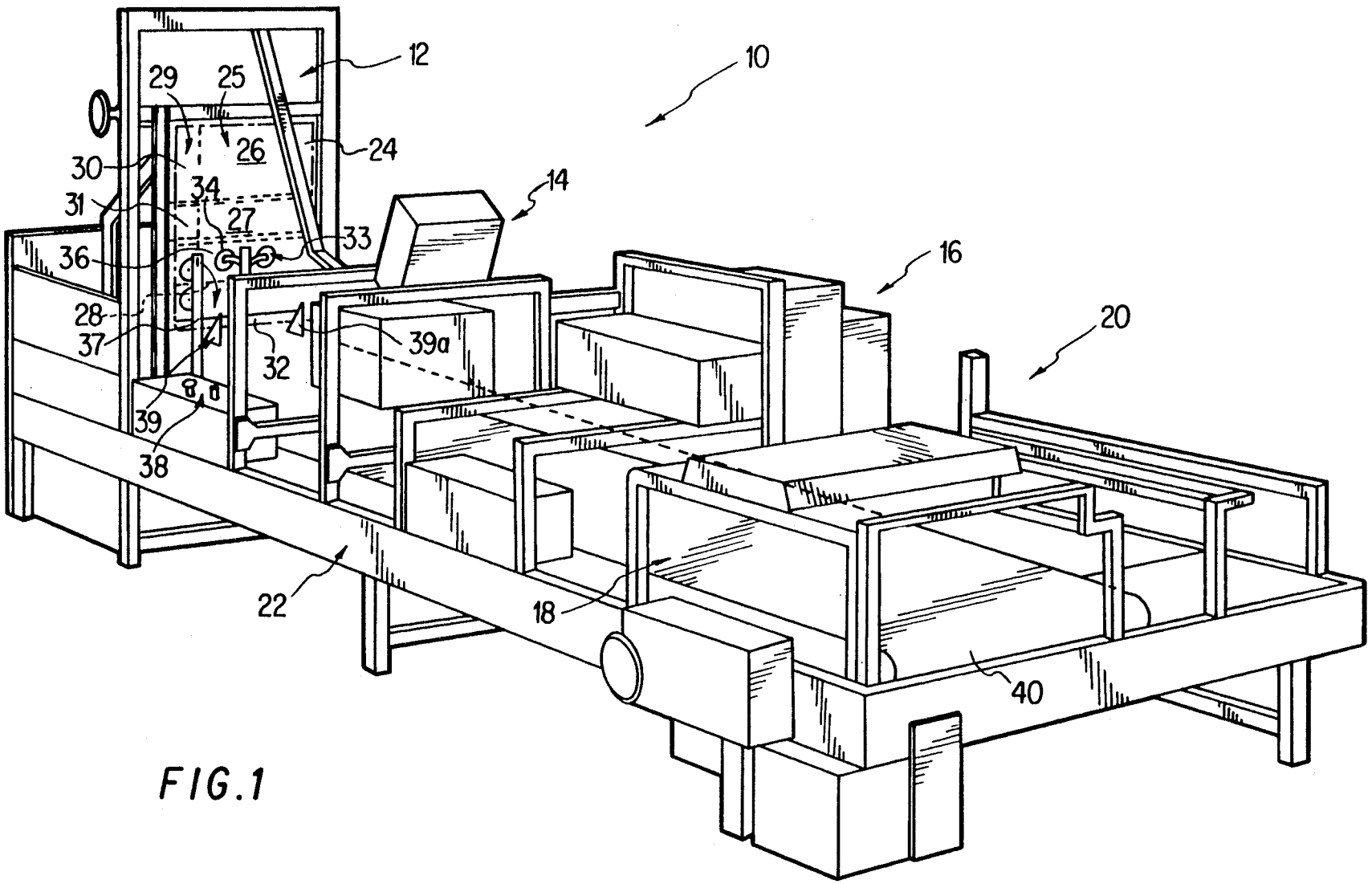
FIG. 1 is a perspective side view of a wrap-around carton packing machine of the type with which the packing apparatus and methods of the disclosed invention can be used.

With reference to the drawings, wherein like reference characters represent like components throughout the various views, and with particular reference to FIG. 1, there is depicted a wrap-around carton packing machine, designated generally by reference character 10, such as the Model 5WR manufactured by Schneider Packaging Equipment Co., Inc. of Brewerton, N.Y., which is illustrative of the prior art type of packing apparatus whose performance can be improved by including the apparatus and methods of the subject invention described below. The packing machine 10 is comprised of a plurality of stations, designated generally by reference characters 12, 14, 16, 18 and 20, that are mounted along a frame assembly 22. The first station, designated by reference character 12, provides for the initial stages of carton erection from a cardboard carton blank 24. Each carton blank 24 is comprised of a plurality of panels 25 which form the top, base and sidewalls of the carton. The carton top and base are formed from length panels 26, whereas the carton sidewalls are formed from width panels 27 which are generally (but not necessarily) narrower than are the length panels. The panels 25 are separated from one another by a pre-fold or score line 28 to facilitate carton blank folding therealong. The blank 24 typically further includes a plurality of flaps 29 which extend from the ends of the panels. Major flaps 30 extend from the ends of length panels 26, whereas minor flaps 31 extend from the ends of the width panels 27. While each of the panels 25 is depicted in the drawings having a flap 29 extending from its respective ends, it is to be appreciated that the carton blank 24 can be configured differently from that described above and depicted in the drawings in accordance with the type and dimensions of the carton to be formed thereby. A fifth panel or manufacturer's joint 32 extends from the width panel positioned at the end of the blank 24 to permit the carton sealing. In a manner well known in the packing art, a plurality of cardboard carton blanks 24 can be stored at the station 12 and sequentially removed from storage by an appropriate carton handling apparatus, designated generally by reference character 33, for further processing by the machine 10 in the manner described below.

The handling apparatus 33 can be in the form of a conventional mechanical or vacuum-operable assembly of the type which is operable to engage and remove a single carton blank from a stack of carton blanks. In the illustrated machine 10, a vacuum-operable device is shown which uses negative pressure for application to one side of the carton blank through appropriate vacuum cups 34 that are engageable with the blank so as to permit for carton blank displacement from a generally vertical orientation at the station 12 toward a generally horizontal configuration in the direction of the arrow so as to initiate the process of carton erection. In a manner that is well known in the art and employed in the above-referenced 5WR carton packing apparatus, the cardboard blank 24 is directed against a preliminary box forming assembly 36 that is comprised of a pair of laterally spaced upstanding rollers 37 and a pair of flap folding scissor arms 38 positioned along the near (box carton back end) side of the machine 10. The upstanding rollers 37 (only one of which is visible in FIG. 1) are positioned such that the blank 24 if folded along the score line **28*a* separating the lowermost width and length panels so that these respective panels attain a generally perpendicular orientation as the carton blank 24 is received within a carriage assembly 39 mounted along carton conveyor 40. Upon receipt of the carton blank within the carriage assembly 39, the carton blank assumes a generally J-shaped configuration so as to permit for the receipt of goods therein at the second (loading) station, indicated generally by reference character 14**.

Figure 2:
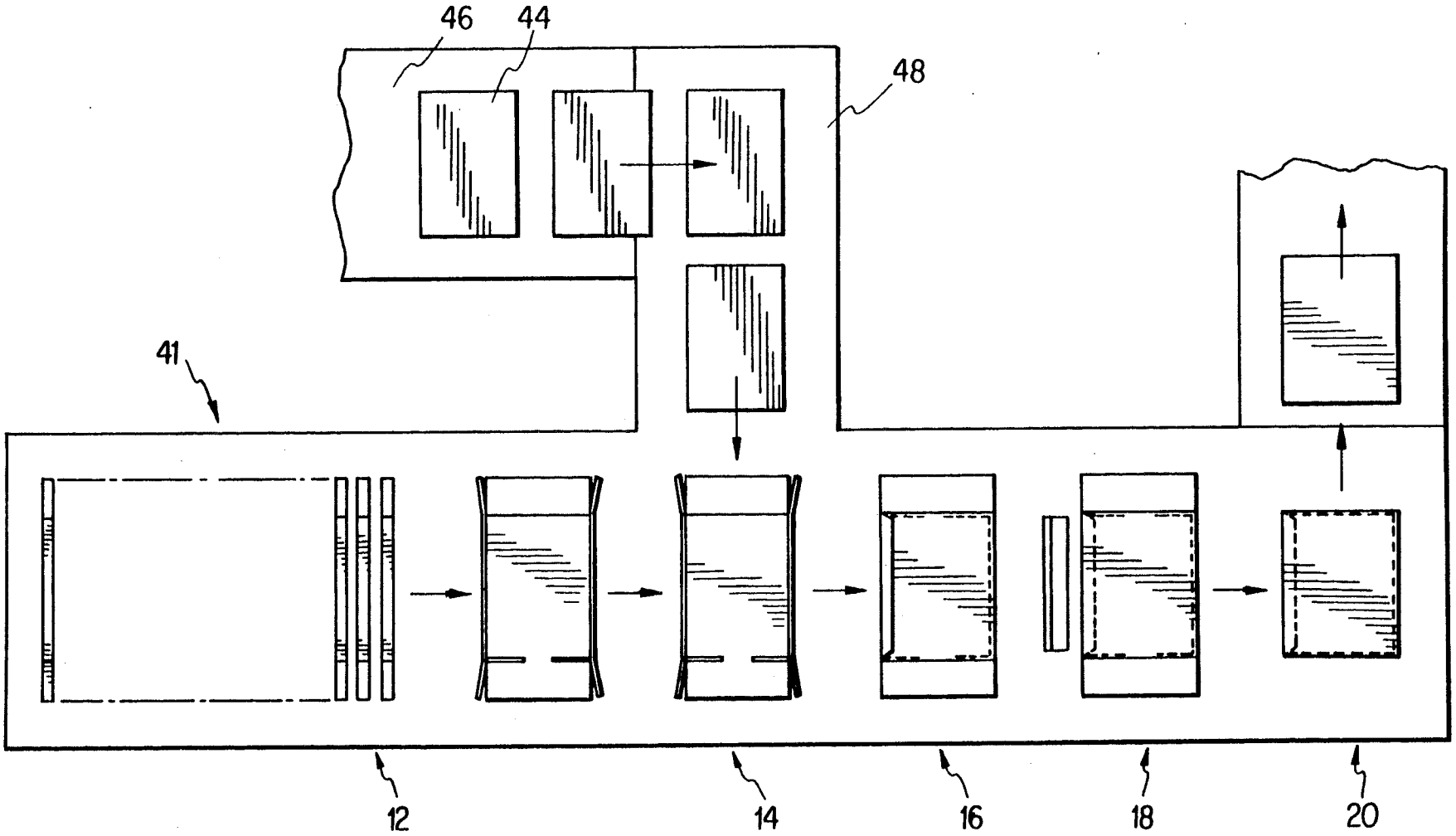
FIG. 2 is simplified overhead view of a carton packing system of the type depicted in FIG. 1 modified so as to provide a linear array of carton forming stations.

Loading of the partially-assembled carton at the loading station 14 is accomplished from a front end of the carton, as illustrated in FIG. 2. Individually packaged consumer products such as soup cans, cereal boxes, coffee cans and brick packs, and the like which are of generally small dimensions, are packed in aggregate form within the carton to facilitate handling of large quantities of the goods during the course of product transport to a distribution center or retail store, at which the carton can be opened and the goods removed therefrom for further processing and/or sale. Once the preliminarily-formed carton has been loaded, it is advanced along the conveyor 40 to a third station 16 for pre-breaking of the manufacturer's joint 32, after which the carton blank is transported to a forth station, designated generally by reference character 18, for application of a suitable box sealant such as hot melt adhesive to the manufacturer's joint 32 and top panel sealing thereto. The carton blank major flaps 30 are sealed to the sides of the carton at the fifth station, designated generally by reference character 20, thereby substantially sealing the entire carton and the goods contained therein.

In typical wrap-around carton packing apparatus such as the type described above, the major flap folding and sealing station 20 is typically positioned at a right angle to the manufacturer's joint gluing and folding station 18, thereby necessitating a sudden and severe change in direction of the carton and goods contained therein as the carton is advanced through the apparatus. Such sudden and drastic changes in direction can cause unsettling and shifting of the goods within the carton, and furthermore necessitates the commitment of a considerable amount of square footage of floor space to accommodate not only the stations of the packing machine, but also further carton handling apparatus which come into play following carton filling and sealing. For these reasons, the third and fourth stations of the above-referenced carton packing apparatus have been modified so as to permit for a new wrap-around carton packing system which provides for a linear array of the aforementioned work stations 12, 14, 16, 18 and 20 in order that sudden and severe changes in direction of the carton and contents contained therein can be avoided altogether and packing plant floor space can be maximized.

Figure 3:
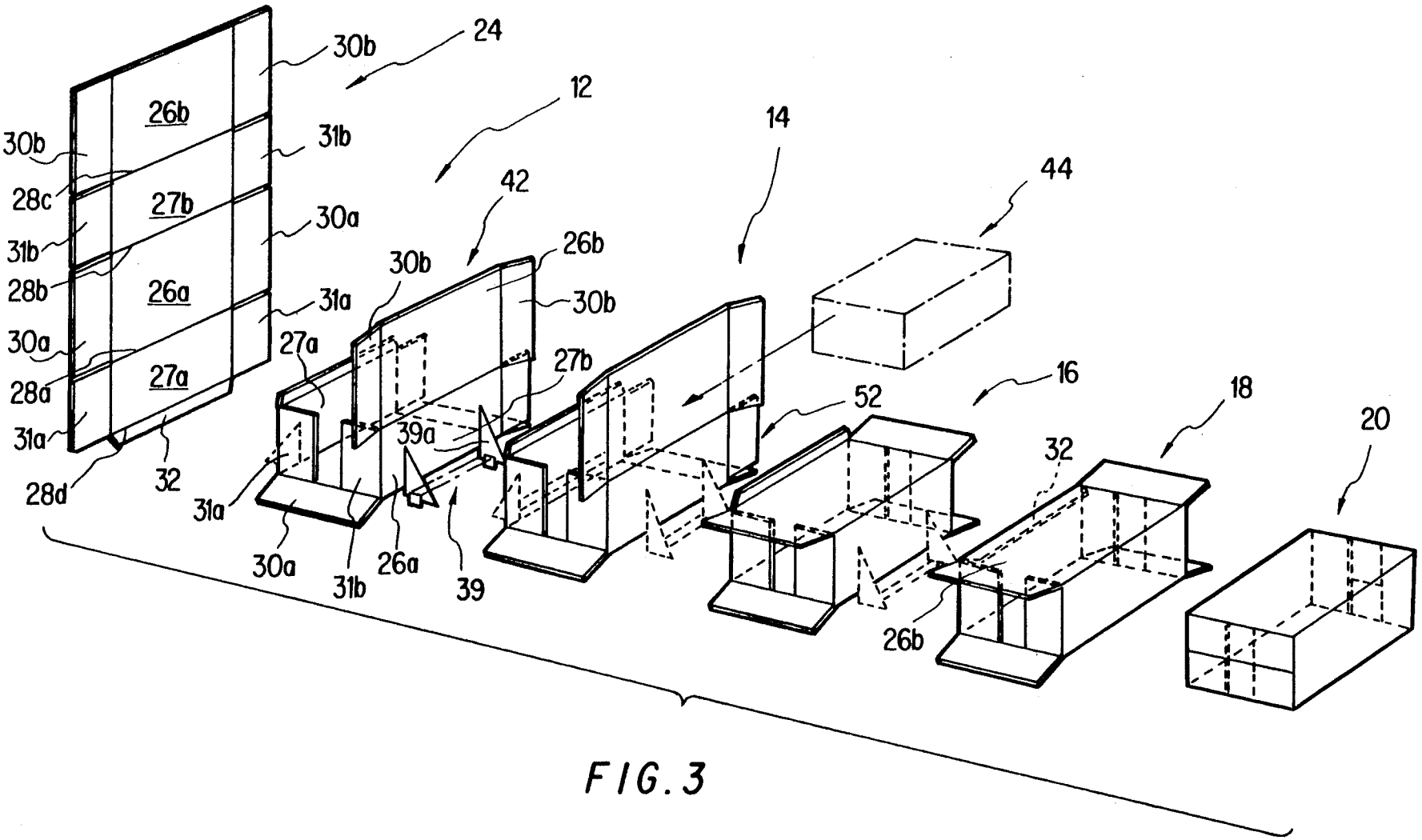
FIG. 3 is a side perspective view of a carton blank illustrating the steps of carton erection, filling and sealing.

Referring now to FIGS. 2 and 3, there is depicted in schematic form an in-line wrap-around carton packing system in accordance with the teachings of the disclosed invention, which can be included as an adaptation of conventional wrap-around carton packing apparatus such as that described above. As is shown in the respective drawing figures, a carton blank 24 having a pre-arranged configuration of panels 25 and flaps 29 is removed from a stacked array 41 of cardboard carton blanks for folding and filling in the manner described below. For the sake of clarity throughout the following detailed description, the various components of the carton blank 24 will be identified by further specific reference characters. The carton blank 24 is configured to provide a conventional four-sided rectangular carton upon assembly. Accordingly, the carton blank includes a width panel 27*a* that is positioned at a first, lower end of the carton blank 24 and adjacent to the manufacturer's joint 32. Side flaps 31*a* extend from both sides of the panel 27*a*. Length panel 26*a* is positioned adjacent to the width panel 27*a* and is separated therefrom by score line 28*a*. Side flaps 30*a* extend from both sides of the length panel 26*a*. A second width panel 27*b* is separated from the length panel 26*a* by a second score line 28*b*. Side flaps 31*b* extend from the sides of the width panel 27*b*. The second length panel 26*b* is separated from the second width panel 27*b* by a third score line 28*c* and includes two side flaps, designated by reference character 30*b*. Although the manufacturer's joint 32 is depicted as extending from the lowermost width panel 27*a* along score line 28*d*, it is to be understood that the manufacturer's joint can alternatively be configured so as to extend from a correspondingly positioned length panel in accordance with the equipment user's preference and the orientation of the packing machine. Placement of the manufacturer's joint adjacent to the first width panel 27*a* is preferred, for it allows resiliency in the manufacturer's joint following its folding or pre-breaking in the manner described below to facilitate bonding engagement with the overlying top panel.

As the cardboard carton blank 24 is directed from the substantially vertical orientation depicted in the drawing to the generally horizontal orientation in the manner described above, it engages the preliminary box forming assembly 36 (FIG. 1) in such a fashion that score line 28*a* separating the first width and length panels 27*a* and 26*a*, respectively, engages the upstanding rollers 37 so as to cause the first width panel 27*a* to assume a generally upright, perpendicular orientation with respect to the first length panel 26*a*, which assumes the position as the carton base. As the carton blank is further directed away from its initial vertical orientation, it is received within the carriage assembly 39, a front end 39*a* of which provides for folding of the carton blank along the second score line 28*b* so as to orient the second width panel 27*b* and attached second length panel 26*b* along a plane which is generally perpendicular to that of the carton base panel 26*a*, thereby providing a partially-formal carton 42 having a J-shaped carton configuration. As carton folding is proceeding, goods 44 such as canned goods, cereal boxes, industrial products and the like are forwarded by a suitable in-feed conveyor 46 to an accumulator conveyor 48 for delivery at station 14 in timed relation to a partially assembled carton 42 at station 14 for loading therein through the carton opening 52 defined by length panel side flaps 30*a*, 30*b* and width panel side flaps 31*a*, 31*b* facing the accumulator 48 (FIG. 2). Once the goods have been loaded into the partially-formed carton 42, the carriage 39 transports the carton 42 to the manufacturer's joint pre-breaking and sealing station 18 for further processing, as is described below in connection with the description of FIGS. 4–6. Preferably, folding of the manufacturer's joint does not proceed until after the second length panel 26*b* is folded downward from its generally vertical orientation to a generally horizontal orientation parallel to the carton base (panel 26*a*) so as to protect the goods 44 received within the carton 42 from glue overspray during the course of subsequent glue application to the manufacturer's joint at the fourth station 18. Once glue has been applied to the manufacturer's joint, the carton top panel 26*b* is elevated above the manufacturer's joint, which is urged downward as the top panel 26*b* is superimposed thereover so as to bind the top panel to the manufacturer's joint. Due to the upward resilient bias of the manufacturer's joint arising from the pre-folding process at the third station, resilient engagement between the manufacturer's joint and the top panel is enhanced. Thereafter, the substantially completed carton 42 is transported to the fifth station 20 for sealing of the major flaps 30*a*, 30*b* to corresponding side flaps 31*a*, 31*b* in a conventional manner, such as by adhesive bonding, stapling, taping or the like.

Figure 4:
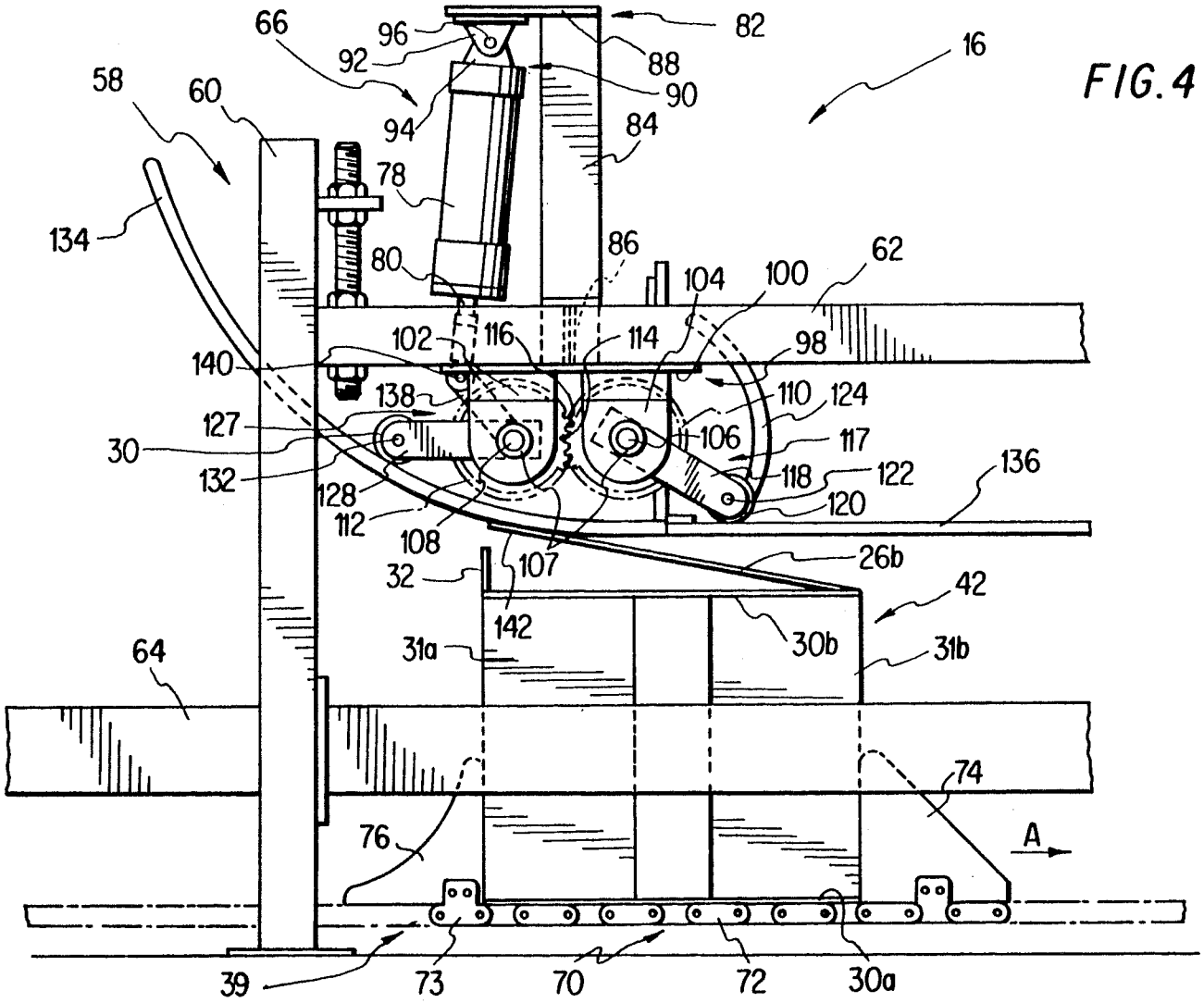
FIGS. 4–10 illustrate in a sequential manner the operation of the packing machinery for manufacturer's joint folding and sealing in the manner embodied by the disclosed invention.
Figure 5:
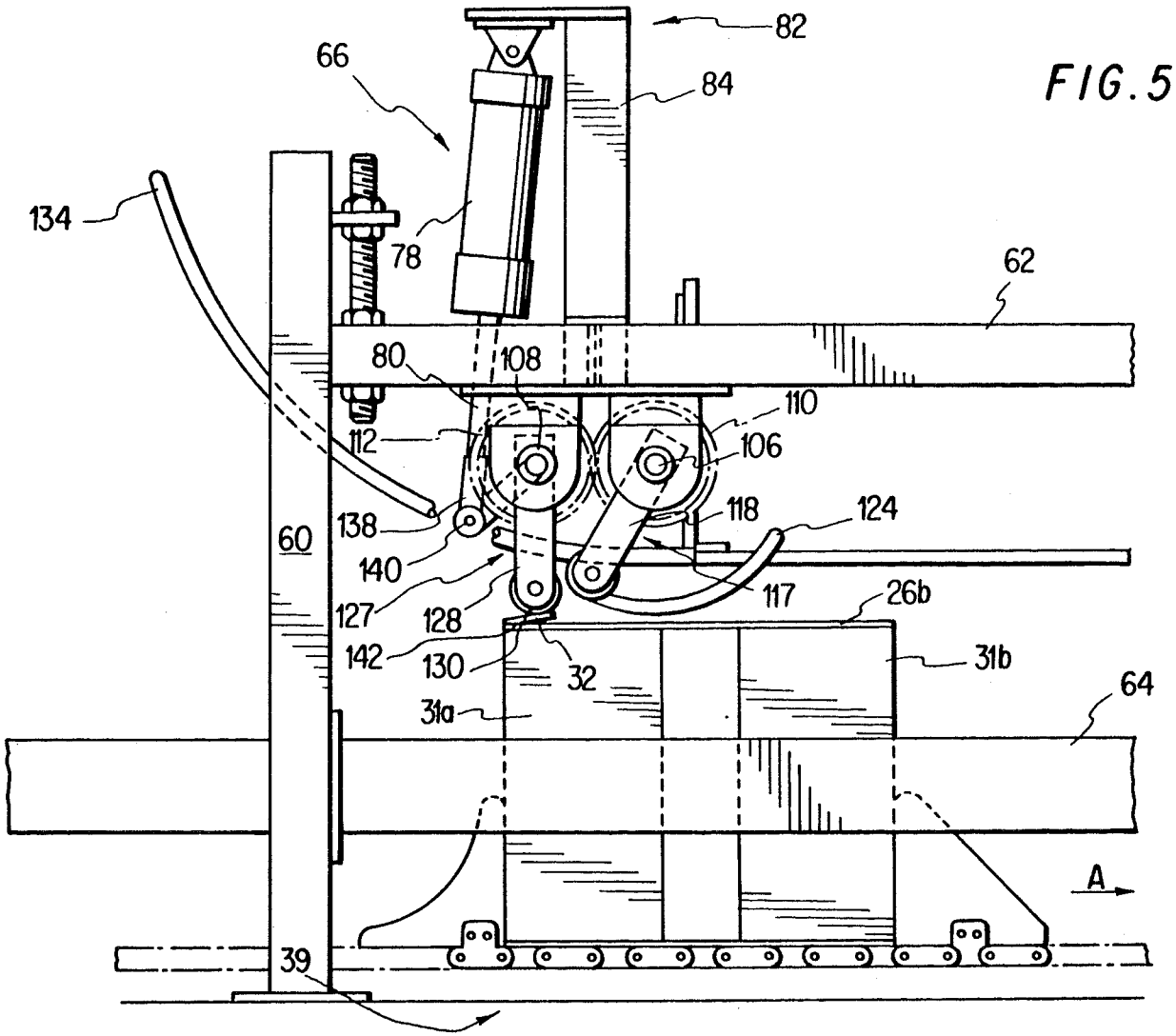

With reference to FIGS. 4 through 10, there are depicted aspects of the manufacturer's joint pre-breaking station 16 and manufacturer's joint glue application and top panel sealing station 18 of the subject invention which permit configuration of a wrap-around carton packing machine in an in-line configuration. As was noted previously, configuration of the overall machine in an in-line manner affords an economy of floor space utilization as well as the minimization of changes in direction of the partially-assembled carton and goods contained therein during the course of carton assembly. With particular reference to FIGS. 4 and 5, details of the components comprising the third station 16 are depicted. The station includes a frame assembly 58 comprising a pair laterally spaced vertical supports 60 from which extend a corresponding one of a pair of upper horizontal supports 62 and lower horizontal supports 64. Throughout the following specification, reference will be made to frame structures in the singular so as to more accurately reflect the subject matter of the drawings. However, reference to frame structures in the singular is meant to encompass the corresponding (undepicted) frame structures in the plane of the drawing sheets, unless the context or description provides otherwise. The lower horizontal support 64 adjacent to the back end of the pre-formed carton 42 (i.e., the side nearest the viewer) projects into the page so as to abut against the closed side flaps 31*a* and 31*b* to inhibit product exit from the back end of the carton. Coupled to the upper horizontal support 62 is the panel folding assembly, denoted generally by reference character 66, for effecting top panel folding and manufacturer's joint breaking in the manner described in detail below. The drawing also illustrates the spatial relationship of the carton 42 carried within the carriage assembly 39 with respect to the various components of the station, most notably the panel folding assembly 66. In a manner well known in the packing art, the carriage assembly 39 and partially assembled carton 42 carried thereby are transported along the conveyor 40 to a position in indexed relation to the panel folding assembly 66, the details of which are illustrated in FIGS. 4 and 5. In particular, FIG. 4 illustrates the configuration of the panel folding assembly components upon carton receipt within the station, whereas FIG. 5 illustrates the configuration of the folding assembly components following top panel folding and manufacturer's joint folding or breakage thereagainst.

With particular reference to FIG. 4, the carriage assembly 39, which maintains the pre-formed carton 42 in a generally rectangular configuration throughout its passage through the packing machine, is comprised of a carrier chain 70 formed from a plurality of chain links 72 to which is attached by an appropriate bracket 73 a pair of laterally-spaced front lugs 74 and rear lugs 76. The front and rear lug pairs are spaced relative to one another in accordance with the dimensions of the carton to be carried thereby.

The panel folding assembly 66 is itself generally comprised of a generally vertically-oriented pressurized fluid cylinder 78 such as a pneumatic cylinder having a cylinder rod 80 reciprocably extensible therein. The cylinder 78 is supported generally above the upper horizontal support 68 by a cylinder support assembly 82 that is comprised of a vertical support 84 that is connected at its lower end to a transversely-extending beam 86 which couples the support 84 to the two upper horizontal supports 62. The cylinder 78 is connected to the vertical support 84 through a horizontally-disposed plate member 88 to which a back end 90 of the cylinder is connected through a conventional U-shaped bracket 92. The bracket 92 defines a pair of laterally-spaced arms between which is received a flange 94 extending from a back end of the cylinder. A hinge pin 96 extends transversely through an aperture formed in the respective aligned bracket arms and cylinder flange to couple the cylinder to the support 84.

Underlying the upper horizontal support 62 and supported thereby is a sub-assembly 98 of mutually engageable gears for effecting manufacturer's joint folding in a manner described below. The gear sub-assembly 98 includes a support bracket 100 from which depend a pair of front and rear gear support flanges 102 and 104, respectively, of which a single one of each pair is illustrated in the drawing. An axle 108 extends between the pair of front flanges 102 and is supported by a bearing 107. An axle 106 extends between the rear flange pair 104 and is likewise supported by a bearing 107. A spur gear 110 is fixedly mounted to the rear axle 106, the rotation of which is operatively coupled or slaved to rotation movement of a spur gear 112 fixedly mounted to the front axle 108. The rear and front spur gears 110 and 112 each respectively carry a plurality of intermeshing teeth 114 and 116 along at least a portion of their respective peripheries. Fixedly coupled to the rear axle 106 are a plurality of panel roller assemblies 117, each of which is comprised of a pair of laterally spaced roller support arms 118 and a panel roller 120 that is coupled to the respective support arms 118 through an axle 122. Preferably, a number of panel roller assemblies 117 is mounted to the axle 106 that is sufficient to extend substantially the entirety of the depth (i.e., the dimension of the carton extending into the page of the drawings) of the carton 42. A curved guide bar 124 extends from at least one of the arms 118 of each assembly 117 for the purpose of guiding the top panel 26*b* downward as the panel rollers 120 are brought into engagement with the top panel.

A similar arrangement of panel roller assemblies to that recited for the rear spur gear axle 106 is provided for the front spur gear axle 108. More particularly, the roller assemblies 127 associated with the front spur gear axle 108 include a pair of laterally-spaced roller support arms 128 that are fixedly mounted at one end thereof to the spur gear axle 108 and carry a roller wheel 130 that is supported by an axle 132 extending between the roller support arms 128 of each support arm pair. Extending between the two pairs of paired support arms 128 is a curvilinear guide bar 134 which extends from a support brace 136 in a direction counter to that of movement of the carriage assembly 39 and carton 42 carried thereby. Rotational control is imparted to the axle 108 and roller assemblies 127 carried thereby from the actuation cylinder 78 through a control arm 138 that is fixedly mounted at one end thereof to the axle 108 and is pivotably coupled at the second end thereof to a free end of the reciprocably-extensible cylinder rod 80. Coupling between the control arm 138 and cylinder rod 80 is accomplished by conventional pivotable coupling apparatus such as a hinge pin 140 that is extensible through aligned and correspondingly dimensioned apertures formed in the control arm and rod.

Operation of the top panel and manufacturer's joint folding station 16 of the disclosed invention will now be described. A pre-manufactured carton 42 having a substantially J-shaped configuration is transported to the top panel and manufacturer's joint folding station 16 by the carriage assembly 39. Upon attainment of a predetermined position within the station 16, the carriage stops in registration with the panel folding assembly 66. As the carton 42 is advanced towards its registration position within the station, the upwardly-extending top panel **26*b* is engaged by the curvilinear guide bar 134 and is urged downwardly thereby. At this initial stage of cylinder operation, the cylinder rod 80 is in the retracted position, thereby positioning the respective associated roller assemblies 117 and 127 apart from one another so as to assume the position illustrated in FIG. 4. With reference to this drawing, it is to be noted that the roller assemblies 117 of the rear axle 106 are positioned at an angle of approximately 60° with respect to the vertical, whereas the roller assemblies 127 are positioned at an angle of about 90° relative to the vertical. Upon actuation of the cylinder 78 so as to outwardly extend the cylinder rod 80, rotational driving input is imparted by the cylinder to the spur gear axle 108, thereby rotatably driving the spur gear 112 fixedly mounted thereto in a counter-clockwise direction so as to rotatably drive the slaved spur gear 110 in a clockwise direction, thereby urging the respective roller assemblies 117 and 127 carried by the respective spur gear axles 106 and 108 toward one another to the position depicted in FIG. 5. As the spur gear 112 is rotatably driven in the foregoing manner, the rollers 130 coupled thereto are pivoted into engagement with the manufacturer's joint 32 and rolled thereagainst so as to bend or "break" the joint along the score line 28*d* separating it from the adjoining width panel 27*a*. As the rollers 130 are pivoted toward the manufacturer's joint in the foregoing manner, rollers 120 associated with the slaved spur gear 110 are pivoted toward the top panel 26*b* and, as a result of the closer physical proximity to the top panel 26*b*, physically engage the top panel along with the associated curvilinear guide bar 124 to urge the top panel 26*b* downwardly toward a generally parallel orientation with respect to the carton base panel 26*a*. As a result of the foregoing roller proximity, the top panel 26*b* is urged downward to its desired, parallel orientation with the base panel prior to physical engagement of the rollers 130 with the manufacturer's joint 32. Accordingly, as the cylinder rod 80 is extended further from the cylinder 78, the rollers 130 are pivoted toward the manufacturer's joint 32 and rolled thereagainst, thereby bending the manufacturer's joint over the free end 142 of the top panel 26*b*, as shown in FIG. 5. Once the break has been formed in the manufacturer's joint in the foregoing manner, the cylinder rod 80 is retracted within the cylinder 78, thereby rotatably driving the associated spur gear 112 in a clockwise direction to pivotably displace the rollers 130 away from the manufacturer's joint from the position depicted in FIG. 5 to the position depicted in FIG. 4. As the spur gear 112 is rotatably driven in this manner, the slaved spur gear 110 is rotated in a counter-clockwise direction so as to pivotably displace the rollers 120 and guide bar 124 associated therewith from the position depicted in FIG. 5 to that depicted in FIG. 4. As the cylinder rod 80 is further retracted within the cylinder 78, the carriage assembly 39 is advanced in accordance with conventional timing control input to a predetermined indexed position within the manufacturer's joint glue application and top panel sealing station depicted in FIGS. 6–10**.

Figure 6:
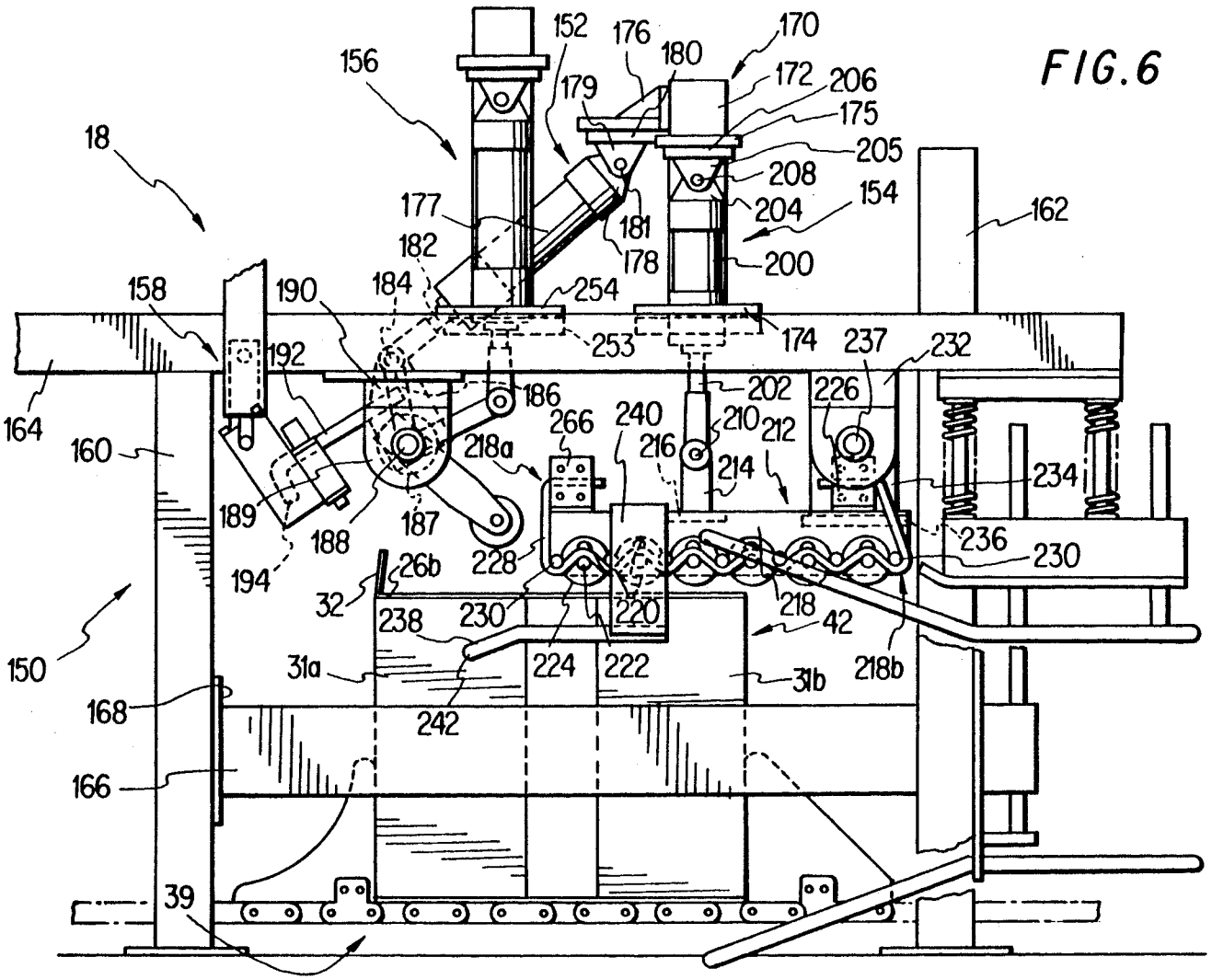

With reference to FIG. 6–10, and particularly to FIG. 6, the manufacturer's joint gluing and top panel working apparatus is depicted as being generally comprised of a station frame assembly 150 which supports the following sub-assemblies: a manufacturer's folding and joint tucking assembly 152, a top panel lifting assembly 154, a manufacturer's joint sealing assembly 156, and a sealant application assembly 158, the details of each assembly being described below. Sequential operation of the foregoing assemblies is controlled in a conventional manner, such as with a suitable arrangement of air tank(s), conduits and controlled valves (not shown) so as to ensure proper sealing of the top panel to the manufacturer's joint. The frame assembly 150 includes a pair of laterally-spaced front and rear vertical supports 160 and 162, respectively, which, in turn, support a pair of upper horizontal supports 164 and lower horizontal supports 166, of which a single one of each pair is depicted in these side views. The respective horizontal supports 164 and 166 are mounted to the respective vertical supports 160 and 162 by appropriate brackets 168 . The upper horizontal support 164 can be formed continuously with the horizontal support 62 of the third station 16 (FIGS. 4 and 5) of the disclosed invention. The near lower horizontal support 166 projects into the page to abut against the closed side flaps **31*a* and 31*b* of the carton 42 so as to inhibit product egress through the partially open back side of the pre-formed carton 42**.

Each of the respective manufacturer's joint and top panel working sub-assemblies 152, 154 and 156 is coupled to the station frame assembly 150, and particularly to the upper horizontal support 164 thereof. More particularly, the manufacturer's joint tucking assembly 152 is coupled to the upper horizontal support 164 through a sub-frame 170 which extends generally transversely upwardly from the horizontal support 164. The sub-frame 170 includes a beam 172 which extends upwardly from the horizontal support 164 and is coupled thereto in a conventional manner at a lower end of the beam by a bracket 174. First and second flanges 175 and 176 extend transversely from the beam 172 in mutually perpendicular planes and support in the manner described below components of the respective top panel lifting and manufacturer's joint folding and tucking assemblies 154 and 152, respectively.

The manufacturer's joint tucking assembly 152 includes a pressurized fluid cylinder 177 having a flanged back end 178 that is receivable within the arms 179 of a generally U-shaped bracket 180. A hinge pin 181 extends through an aperture formed in the bracket arms 179 and cylinder flange 178 to vertically mount the cylinder 177. A cylinder rod 182 is reciprocably extensible within the cylinder 177. The free end of a cylinder rod 182 is pivotably connected by a hinge pin 184 to one end of a connecting arm 186. The other end of the connecting arm 186 is rigidly affixed to a cylindrical sleeve 187 rotatably supported by a portion of an axle 188 extending between a pair of arms 189 depending from the horizontal support 164. Extending from the sleeve 187 is a spacer 190 to which is affixed one end of a generally L-shaped bar 192, the lower, curved end 194 of which is engagable with the manufacturer's joint 32 upon actuation of the cylinder 180 in the manner described below.

The top panel lifting assembly 154 includes a pressurized fluid cylinder 200 from which extends a reciprocably-extensible cylinder rod 202. A back end of the cylinder is provided with a flange 204 which is dimensioned so as to be received between the arms 205 of a generally U-shaped bracket 206. A hinge pin 208 extends through an aperture formed within the flange and bracket so as to pivotably support the cylinder 200 from the sub-frame 170. A free end of the cylinder rod 202 is connected by a hinge pin 210 to the top panel tensioning sub-assembly 212 by a connecting arm 214. A lower end of the connecting arm 214 is coupled to a transversely extending brace 216 which supports a plurality of pairs 217 of roller support plates 218 arranged parallel to one another, of which the end plate 218 of the end plate pair 217 closest to the viewer is depicted. Each plate 218 is provided with a plurality of laterally spaced, vertically disposed slots 220 through which extend an axle 222 which rotatably supports a roller 224. Brackets 226 positioned along a front and back end 218*a*, 218*b* of each of the plates 218 mount a roller tensioning cord 228 which transverses a serpentine path between adjacent roller axles 222 and tensioning pins 230 fixedly mounted to the plates 218 and extending perpendicularly therefrom generally parallel to the axles 222. The tensioning cord 228 is preferably in the form of a urethane rope and is adjustably positionable within each of the brackets 226 so as to provide for an appropriate downward tension upon the roller axles 222 and rollers 224 carried thereby in accordance with the height of the carton 42 received within the station and the extent (if any) to which the top panel is upwardly distended by the contents of the carton. Because the urethane is stretchable and exhibits an elastic memory, each roller 224 is independently responsive to pressures exerted by the contents of the container so as to be displaced away from the container top panel 26*b* upon displacement of the a given roller axle 222 within the slot 220. Due to the elastic memory of the cord 228, however, the roller 224 is returned to the rest position with the axle 222 at the lowermost portion the slot 220 upon the release of pressure exerted against the roller. Tensioning of the rollers 224 in the foregoing manner permits for the exertion of a user-selected range of pressures against the carton top panel 26*b* as the carton 42 is advanced through the station 18.

The back end of the top panel tensioning sub-assembly 212 is pivotably coupled to the upper horizontal support 164 through a generally inverted U-shaped bracket 232 having a pair of laterally spaced arms 233 between which is received a vertically-upstanding flange 234 extending from a cross-brace 236 coupling each of the roller support plates 218. A pivot pin 237 extends through a correspondingly dimensioned aperture extending through the bracket arms 233 and flange 234 received therebetween so as to pivotably support the back end of the top panel tensioning sub-assembly 212. Upon pivotable displacement of the top panel tensioning sub-assembly 212 in the manner described below, panel lifting arms 238 extending rearwardly from a forward end of each of the outerlying roller support plates 218 engage and elevate the top panel 26*b* above the manufacturer's joint 32 so as to permit positioning of the manufacturer's joint thereunder prior to top panel sealing. The lifting arms are coupled to the respective end plates by brackets 240. Preferably, the upstream, free end 242 of each lifting arm 238 is inclined downwardly so as to facilitate positioning of the lifting arm 238 underneath the corresponding flap 30*b* as the partially assembled carton 42 is transported by the carriage 39 to its registration position within the station.

Figure 7:
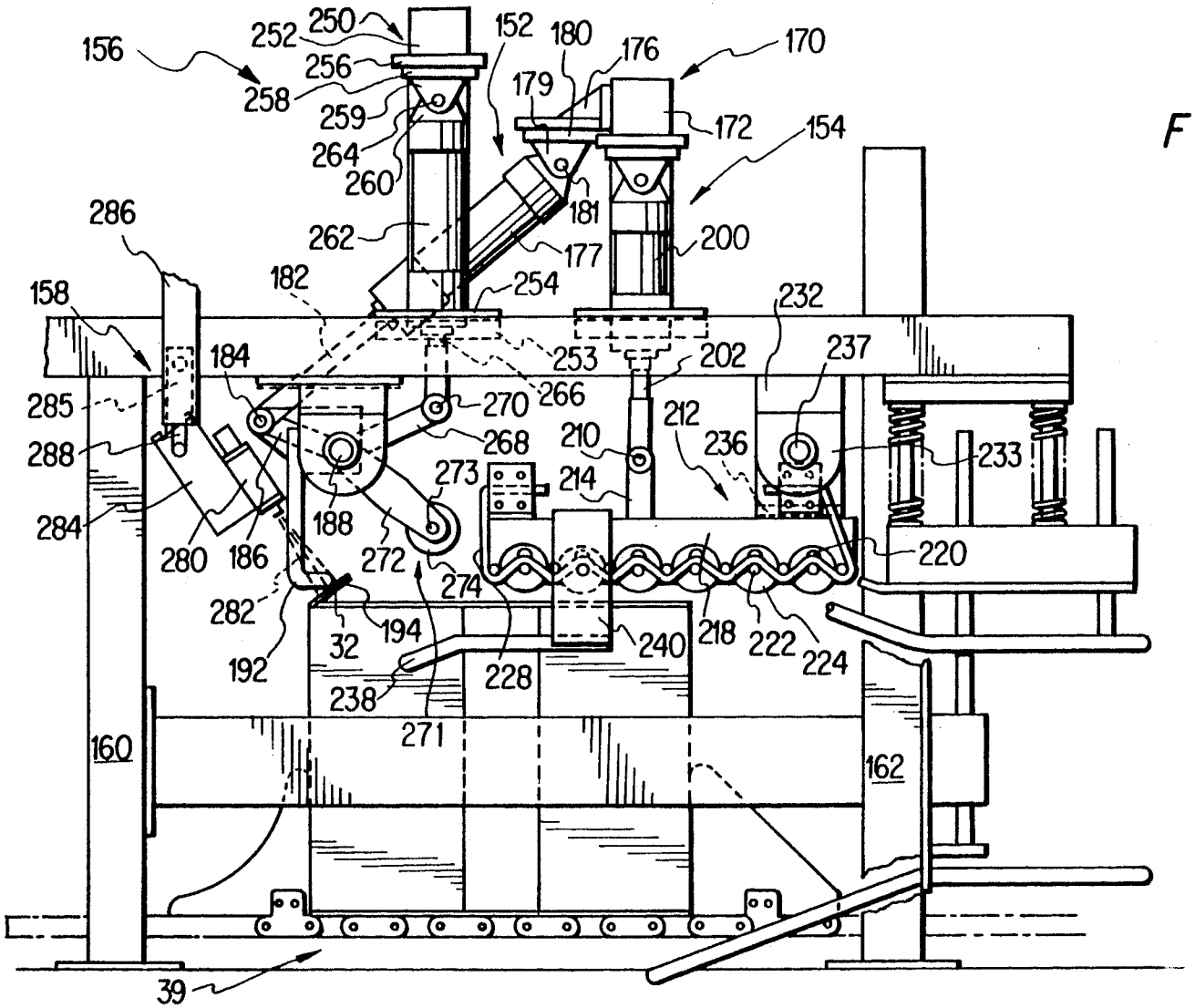

With particular reference to FIG. 7, details of the manufacturer's joint sealing and sealant application assemblies 156 and 158, respectively, will be described in conjunction with their respective modes of operation. The manufacturer's joint sealing assembly 156 is generally supported by a sub-frame 250 that includes a beam 252 which is vertically upstanding from a cross-brace 253 extending between the horizontal supports 164 and is coupled thereto by a mounting bracket 254. A flange 256 extends generally transversely outwardly from the beam 252 at an upper end thereof. A generally U-shaped inverted bracket 258 is mounted to the flange 256 and is dimensioned to receive between the arms 259 thereof a flange 260 extending from a back end of a fluid-actuated cylinder 262. A hinge pin 264 extends through a correspondingly-dimensioned aperture formed in the bracket arms 259 and a cylinder flange 260 so as to suspend the cylinder 262 in a generally vertical orientation. A cylinder rod 266 is reciprocably extensible within the cylinder 262 and is pivotably coupled to one end of a connecting rod 268 by a hinge pin 270. The second, free end of a connecting rod is fixedly attached to the axle 188 described above, such that reciprocable extension of the cylinder rod 266 effects rotatable displacement of the axle 188 within the axle arms 189. Fixedly coupled to the axle 188 and depending therefrom is a pair of laterally-spaced roller support assemblies 271, each of which includes a pair of spaced roller support arms 272. An axle 273 extends between the support arms 272 and rotatably mounts a roller 274. Preferably, a plurality of roller assemblies 271 are spaced along the length of the axle 188 so as to extend substantially the entirety of the depth of the top panel 26*b* (exclusive of side flaps 30*b*).

The manufacturer's sealant application assembly 158 is comprised of a plurality of spray modules 280, such as the model M3967 manufactured by Nordson Corp. of Amherst, Ohio, which are operable to emit a sealant spray in a predetermined pattern 282. The spray modules 280 are mounted along a support manifold 284 which defines therein a sealant reservoir for supply of the modules 280. The manifold 284 is coupled to the horizontal upper support 164 by a plurality of mounting brackets 285 which extend across the depth of the manifold into the plane of the page. Sealant is expelled from the manifold 284 into the spray modules 280 in a conventional manner upon the delivery of heated glue under pressure through line 286, which is coupled to the manifold through an appropriate fluid fitting 288.

Operation of the manufacturer's joint sealant application and top panel folding stations will be described in connection with the sequential illustrations in FIGS. 6–10. The carriage 39 is operable in the manner described above to transport a partially-formed carton 42 to a point of registration within the station, as indicated by FIG. 6. Thereafter, the manufacturer's joint tucking assembly 152 is operable in a conventional manner to direct the generally L-shaped bar 192 into engagement with the manufacturer's joint 32 so as to displace the manufacturer's joint rearwardly to the position illustrated in FIG. 7. Pivotable displacement of the L-shaped bar 192 is accomplished by extension of cylinder rod 182 outwardly from cylinder 177, thereby supplying rotational input to the sleeve 187 and directing the bar 192 coupled to the sleeve to pivot in a counter-clockwise direction so as to engage and displace the manufacturer's joint in the foregoing manner. While the manufacturer's joint 32 is held by the arm 192 in the position depicted in FIG. 7, the sealant application assembly 158 is operable to emit a sealant spray from the spray modules 280 thereof so as to deposit a suitable sealant such as a hot melt adhesive upon an outer surface of the manufacturer's joint for bonding with the top panel 26*b* in the manner described below. The spray of sealant is effectuated upon the delivery of a suitable quantity and pressure of fluid through the supply line 286, thereby directing sealant from the reservoir within manifold 284 into the modules 280. The modules 280 are preferably arranged so as to be detachably mounted to the manifold 284 so as to permit for their servicing, replacement or re-configuration thereon in accordance with such varied factors as the dimensions of the manufacturer's joint upon which sealant is to be applied and the desired pattern of sealant application. Once the sealant has been applied to the manufacturer's joint, the cylinder 177 is operable to retract cylinder rod 182 therein, thereby effecting a clock-wise rotational input to sleeve 187 and the return on the L-shaped bar 192 to the position indicated in FIG. 6.

Figure 8:
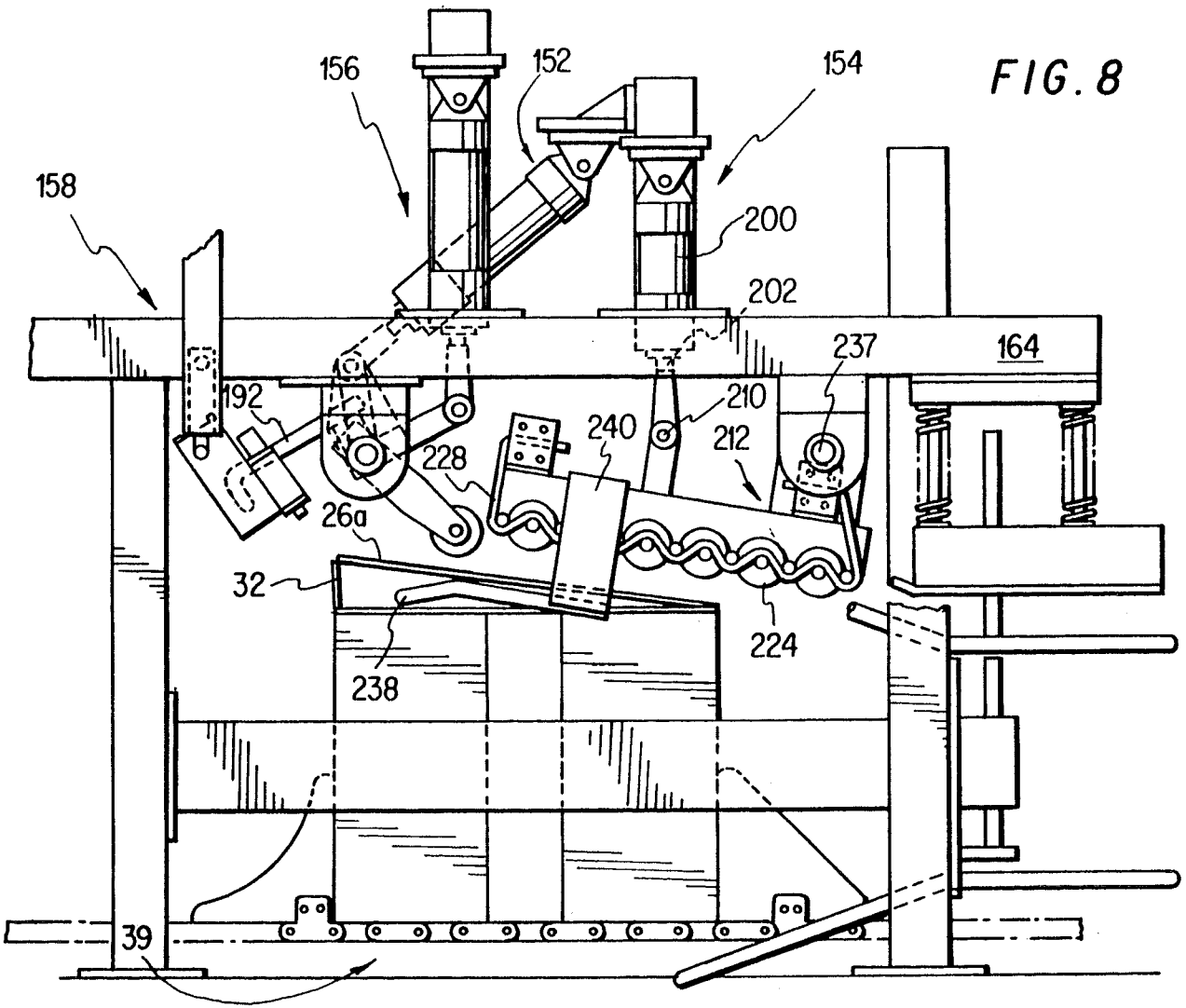
Figure 9:
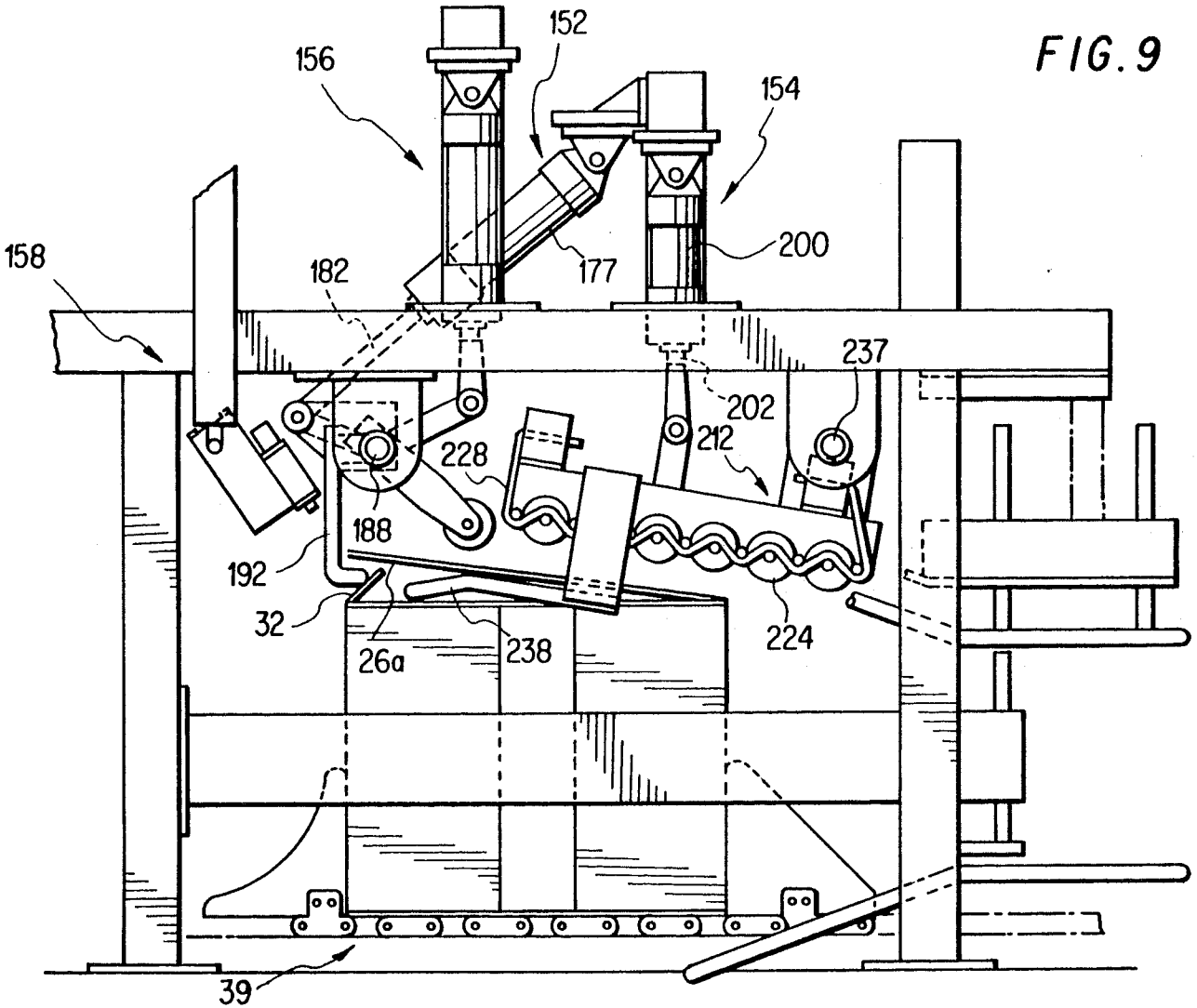
Figure 10:
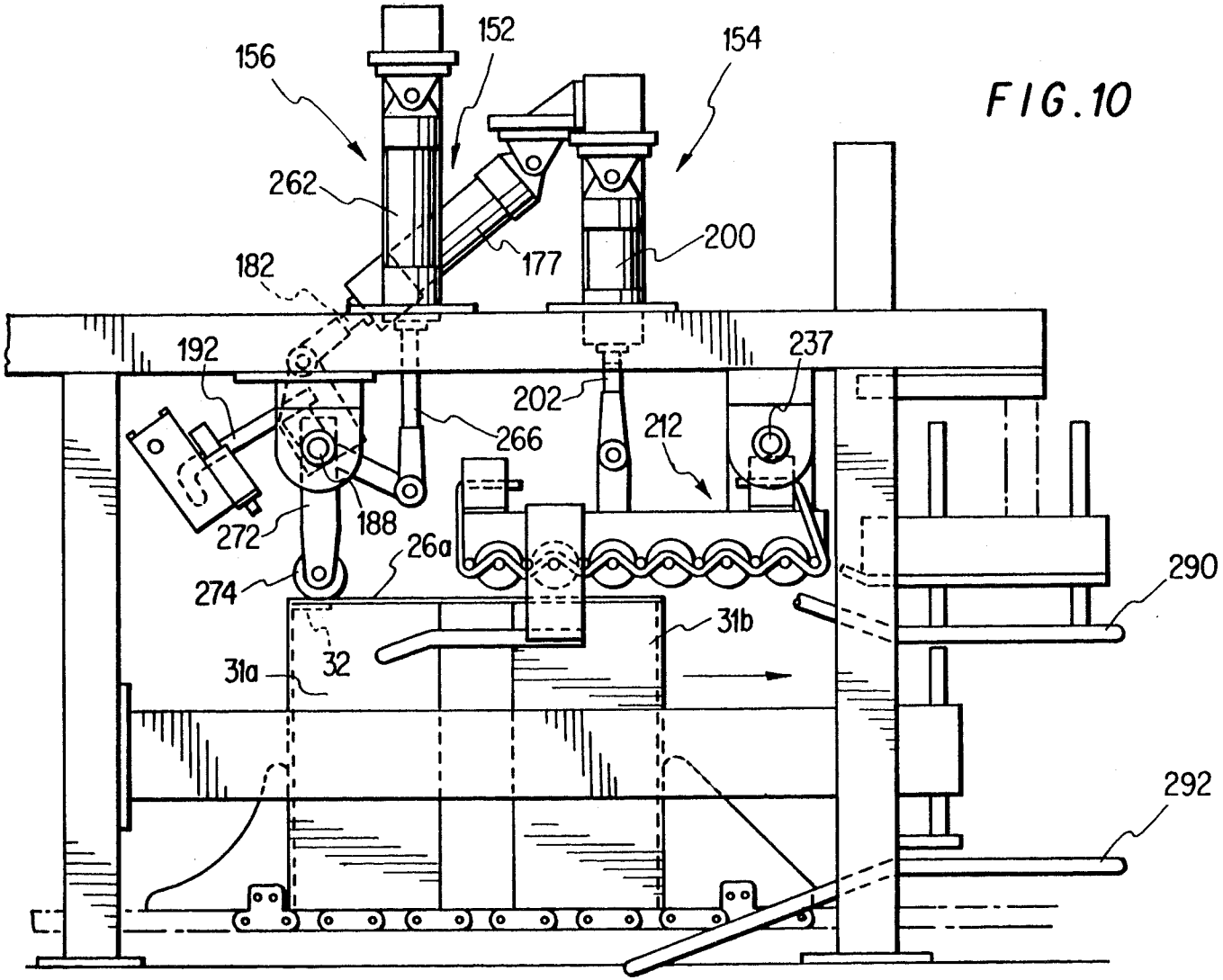

Upon the completion of sealant spray application, the top panel lifting assembly 154 is operable so as to direct elevation of the top panel 26*b* from a position below the manufacturer's joint toward a position above it, as illustrated in FIG. 8. The elevation of the top panel is accomplished by retracting cylinder rod 202 within cylinder 200, thereby effecting a pivotable upward displacement of the top panel tensioning sub-assembly 212 along pivot axle 237. As the top panel tensioning sub-assembly 212 is displaced in the foregoing manner, the top panel lifting arms 238 depending therefrom are brought into engagement along the underside of the top panel flaps 30*b*, thereby pivotably displacing the top panel 26*a* as shown in the drawing. While the top panel tensioning sub-assembly 212 is in the upwardly displaced position, the manufacturer's joint tucking assembly 152 is operable so as to reciprocably extend cylinder rod 182 from cylinder 177, thereby imparting counter-clockwise rotational input to axle sleeve 187 and engagement of the L-shaped arm 192 with the manufacturer's joint 32 so as to displace it to a position underlying the free end of the top panel 26*a*, as shown in FIG. 9. Once the manufacturer's joint has been displaced so as to underlie the top panel 26*a*, the top panel lifting assembly is operable to extend cylinder rod 202 from cylinder 200 so as to lower the top panel tensioning sub-assembly 212 and urge the top panel 26*a* into engagement with the manufacturer's joint 32. At about the time of downward displacement of the top panel tensioning sub-assembly 212, cylinder rod 266 of the manufacturer's joint sealing assembly 156 is extended from cylinder 262, thereby imparting a clockwise rotational pivoting displacement of the axle 188 and associated top panel rollers 274 thereof, and arm 192 is retracted to its home (retracted) position. As the roller support arms 272 carrying the rollers 274 are displaced to the generally vertically upstanding orientation depicted in FIG. 10, the rollers are directed into engagement with the top panel 26*a* so as to urge the top panel into frictional engagement with the manufacturer's joint and the sealant associated therewith, thereby effecting sealing of the carton top panel to the manufacturer's joint. Following extension of the cylinder rod 266 and resultant clockwise pivotable displacement of the roller arm 272 and associated roller 274 in the foregoing manner, the cylinder rod 266 is retracted within cylinder 262, thereby imparting counter-clockwise rotational input to the axle 188 so as to pivotably displace the roller arms 274 and associated rollers away from the top panel 26*a* to the rest position depicted in FIG. 9. Once the roller 274 has been displaced away from the top panel in the foregoing manner, the carriage assembly 39 can be commanded to transport the carton 42 from the manufacturer's joint folding station 18 in the direction of the arrow A to permit for sealing of the major flaps 30*a* and 30*b* to the carton side flaps 31*a* and 31*b*. Major flap sealing can be accomplished in any of a variety of conventional ways at a subsequent, downstream sealing station.

The foregoing method and apparatus enable the manufacturer's joint to be sealed to the carton in a manner which more completely protects product within the carton from sealant overspray and which permits the manufacturer's joint to be folded along an interior surface of the carton, thereby rendering a carton having a substantially uniform, smooth exterior surface which facilitates carton handling and stacking. The foregoing method and apparatus also provide for carton packing which can proceed along a substantially linear path from carton erection to filling and sealing, thereby maximizing the efficiency of floor space utilization and eliminating altogether the occurrence of sudden and extreme shifts in angular orientation of the carton and goods contained therein. It will be appreciated that the various panel working assemblies of the subject invention can be controlled by any of a variety of conventional control means, such as pneumatic control means commonly associated with packing apparatus.

What is claimed is:

1. A method of forming and sealing a carton, comprising the steps of:

providing at least one carton blank having a plurality of panels and a manufacturer's joint extending from a first of two carton blank end panels;

folding the panels so as to form the carton blank into a partially formed carton having a generally J-shaped configuration;

further folding the panels to position the second end panel adjacent to the manufacturer's joint;

folding the manufacturer's joint toward the carton blank second end panel so as to overlie at least a portion of said second end panel;

applying carton sealing means to the manufacturer's joint while the manufacturer's joint overlies the second end panel for securing the carton blank second end panel to the manufacturer's joint;

displacing said second end panel from underlying relation with said manufacturer's joint; and folding the carton blank second end panel over the manufacturer's joint to secure said second end panel to the manufacturer's joint.

2. The method of claim 1, further comprising the step of inserting at least one article into the carton blank prior to securing the manufacturer's joint to the second end panel.

3. The method of claim 2, wherein an article to be included in the carton is inserted through an opening in a side of the partially formed carton.

4. The method of claim 1, wherein the panels of the carton blank are arranged as carton width and length panels 5. The method of claim 4, wherein said carton blank width and length panels are arranged in an alternating pattern.

6. The method of claim 4, wherein the manufacturer's joint extends from one of said carton blank width panels.

7. The method of claim 4, wherein the manufacturer's joint extends from one of said carton blank length panels.

8. The method of claim 1, wherein the manufacturer's joint is adhesively secured to the second end panel.

9. The method of claim 1, wherein the recited steps are sequentially performed in the order set forth in the claim.

10. The method claim 1, wherein the manufacturer's joint is folded against the second end panel prior to application of the carton sealing means to the manufacturer's joint.

11. The method of claim 1, wherein the carton blank is provided with a folding joint between at least two adjacent panels prior to carton blank folding.

12. The method of claim 1, wherein a plurality of carton blanks are provided in a generally vertically stacked array and are sequentially removed from the array and folded to form a carton.

13. The method of claim 12, wherein negative pressure is utilized to sequentially remove carton blanks from the carton blank array for folding.

14. The method of claim 1, further comprising the step of providing each of said panels with a side flap extending from opposite sides of the panel and folding said side flaps to at least substantially close opposed sides of the carton formed from the carton blank.

15. The method of claim 14, wherein at least two of the carton side flaps are secured to one another.

16. The method of claim 1, wherein the carton blank is folded to form a generally rectangular sealed carton.

17. The method of claim 1, further comprising the step of providing a side flap on a common side of at least two of said carton blank panels and securing the side flaps of said carton panels to one another.

18. The method of claim 17, wherein said side flaps are adhesively secured to one another.

19. An apparatus for folding and sealing a carton blank manufacturer's joint to one of a plurality of carton blank width and length panels, the apparatus comprising:

means for displacing a free end of a first carton blank panel toward a manufacturer's joint extending from a second carton panel;

means for folding the manufacturer's first joint over the first panel free end so as to overlie at least a portion of the first panel;

means for engaging and retaining the manufacturer's joint in overlying relation with the first panel and means for applying a panel sealant to the manufacturer's joint;

means for elevating the first panel free end above the manufacturer's joint; and means for superposing the first panel over the manufacturer's joint to cause said first panel to bond to said manufacturer's joint.

20. The apparatus of claim 19, wherein said manufacturer's joint folding means comprises a roller assembly pivotably coupled to an axle.

21. The apparatus of claim 20, wherein said carton panel free end displacing means comprises a roller assembly pivotably coupled to a support axle.

22. The apparatus of claim 21, wherein the roller assembly of said carton panel free end displacing means comprises a curvilinear guide member said guide member being engageable with the first carton panel upon rotatable displacement of the axle supporting the roller assembly of said carton panel free end displacing means.

23. The apparatus of claim 21, wherein each of said axles comprises a spur gear having gear teeth in intermeshing engagement with one another along at least a portion of the periphery of each spur gear.

24. The apparatus of claim 23, wherein said manufacturer's joint folding means comprises a pressurized fluid cylinder having a reciprocably extensible cylinder rod coupled to said manufacturer's joint folding means axle at a cylinder rod free end.

25. The apparatus of claim 24, wherein said pressurized fluid cylinder is supported by a frame assembly in a substantially vertical orientation adjacent to and above said coupled to the cylinder rod axle.

26. The apparatus of claim 19, further comprising a curvilinear guide member which extends outwardly and upwardly from a frame member to engage the carton blank first panel as the carton blank is advanced into the carton blank panel free end displacing means.

27. The apparatus of claim 19, wherein said panel sealant application means comprises a plurality of spray modules coupled to a sealant reservoir.

28. The apparatus of claim 19, wherein said manufacturer's joint engaging and retaining means comprises a curvilinear arm pivotably displaceable around an axle between a manufacturer's joint engaging position and a retracted position.

29. The apparatus of claim 28, wherein said curvilinear arm is coupled to a free end of a reciprocably extensible cylinder rod selectively operable to displace said curvilinear arm between said engaging and retracted positions.

30. The apparatus of claim 19, wherein said means for elevating the first panel free end comprises a pressurized fluid cylinder having a cylinder rod selectively extensible therefrom and a curvilinear arm coupled to said cylinder rod.

31. The apparatus of claim 30, wherein said curvilinear arm is coupled to said cylinder rod through a first panel tensioning sub-assembly comprising at least one roller engageable with the first panel following panel folding over the manufacturer's joint.

32. The apparatus of claim 31, wherein said first panel tensioning sub-assembly comprises means for resiliently supporting said tensioning sub-assembly roller along an axis generally transverse to the folded first panel.

33. The apparatus of claim 32, wherein said roller resilient supporting means comprises a roller axle receivable within a slot formed in an axle support member and an elastically deformable member which at least partially surrounds the axle and urges said axle toward a lower portion of said slot.

34. The apparatus of claim 33 wherein said elastically deformable member is adjustably positionable to vary tension exerted against said roller axle.

35. The apparatus of claim 31, wherein said first panel tensioning sub-assembly is pivotably coupled to a frame member.

36. The apparatus of claim 35, wherein said cylinder is coupled to said frame member and is oriented generally transverse to the panel following panel folding over the manufacturer's joint.

37. The apparatus of claim 19, wherein said means for superposing the first panel over the manufacturer's joint comprises a pressurized fluid cylinder having a cylinder rod reciprocably extensible therefrom and coupled at a free end of the rod to an axle, a roller assembly being coupled to said axle.

38. The apparatus of claim 37, wherein said roller assembly comprises a roller rotatably supported by a roller support arm that is fixedly mounted to said axle so as to be pivotably displaceable upon rotational displacement of said axle.

39. The apparatus of claim 38, wherein said manufacturer's joint engaging and retaining means comprises a curvilinear arm pivotably displaceable around said axle independently of extension of said cylinder rod.

40. The apparatus of claim 39, wherein said curvilinear arm is secured at an end thereof to a cylindrical sleeve rotatably received by said axle.

* * * * *